US006853827B2

(12) United States Patent
Song et al.

(10) Patent No.: US 6,853,827 B2
(45) Date of Patent: Feb. 8, 2005

(54) LIQUID IMAGE DEVELOPING SYSTEM FORMING A SPACE WITH A DEVELOPMENT ROLLER AND HAVING DEPOSITING PLATE HAVING THROUGH HOLE

(75) Inventors: In-yong Song, Gyeonggi-do (KR); Geun-yong Park, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/245,394

(22) Filed: Sep. 18, 2002

(65) Prior Publication Data

US 2003/0133726 A1 Jul. 17, 2003

(30) Foreign Application Priority Data

Jan. 15, 2002 (KR) ..... 2002-2268

(51) Int. Cl.[7] ..... G03G 15/10
(52) U.S. Cl. ..... 399/237; 399/241
(58) Field of Search ..... 399/237, 240, 399/241, 238, 239

(56) References Cited

U.S. PATENT DOCUMENTS 5,255,058 A 10/1993 Pinhas et al.
5,477,313 A * 12/1995 Kuramochi et al. ..... 399/239
5,561,264 A * 10/1996 Iino et al. ..... 118/661
5,689,779 A * 11/1997 Miyamoto et al. ..... 399/237
5,724,629 A * 3/1998 Iino et al. ..... 399/57

FOREIGN PATENT DOCUMENTS

JP 04090569 A * 3/1992 ..... G03G/15/08

* cited by examiner

*Primary Examiner*—Quana Grainger
(74) *Attorney, Agent, or Firm*—Staas & Halsey LLP

(57) ABSTRACT

A liquid image developing system includes a development container to store a developer; a photosensitive body; a development roller partially soaked in the developer in the development container and to rotate opposite to the photosensitive body; a metering blade to scratch the developer attached to a circumference of the development roller to a predetermined thickness; a depositing plate spaced from the development roller to form a space therebetween; a supplying portion to supply the developer to the space between the development roller and the depositing plate; and a power supply to apply a voltage to the depositing plate so that the developer is transferred to the development roller from the space by an electric force. Accordingly, a high-concentration developer can be directly used in the development operation without a dilution operation, and thus the structure to supply the developer can be considerably simplified.

17 Claims, 4 Drawing Sheets

LIQUID IMAGE DEVELOPING SYSTEM FORMING A SPACE WITH A DEVELOPMENT ROLLER AND HAVING DEPOSITING PLATE HAVING THROUGH HOLE

CROSS-REFERENCE TO RELATED APPLICATIONS

This application claims the benefit of Korean Application No. 2002-2268, filed Jan. 15, 2002, in the Korean Industrial Property Office, the disclosure of which is incorporated herein by reference.

BACKGROUND OF THE INVENTION

1. Field of the Invention

The present invention relates to a liquid image developing system, and more particularly, to a liquid image developing system having a simplified structure using a high-concentration developer.

2. Description of the Related Art

In general, liquid image developing systems form an electrostatic latent image corresponding to a desired image by scanning light on a photosensitive body, developing the electrostatic latent image using a developer in which powder-shaped toner is mixed with a liquid solvent, and printing the developed electrostatic latent image on a paper.

FIG. 1 is an example of a conventional image developing system, disclosed in U.S. Pat. No. 5,255,058. As shown in FIG. 1, the conventional image developing system includes a photoconductive drum 10 charged at a predetermined voltage by a photoconductor charging apparatus 14, and an imaging apparatus 16 (i.e., a laser scanning apparatus) to form an electrostatic latent image of a desired image by scanning light onto the charged photoconductive drum 10 and creating a relative voltage difference. The image developing system also includes a developer supplying unit to develop the electrostatic latent image by supplying a developer to the photoconductive drum 10, and an intermediate transfer member 30 to transfer the developed image onto the photoconductive drum 10 and print the transferred image onto a paper 72.

The developer supplying unit prepares the developer with a toner concentration of less than 3% solid and supplies the developer between the photoconductive drum 10 and a development roller 38. For this purpose, the developer supplying unit includes concentration cartridges 82 and 84 containing a concentrated developer with a toner concentration of 25% solid, a solvent cartridge 86 containing pure solvent, and toner reservoirs 55, 57, 59, and 61 to mix the concentrated developer from the concentration cartridges 82 and 84 with the solvent from the solvent cartridge 86 and prepare a developer with a uniform concentration of about 2–3% solid. The developer supplying unit further includes a multicolor liquid developer spray assembly 20 to pump the developing solvent prepared in the toner reservoirs 55, 57, 59, and 61 to pumps 90, 92, 94, and 96, respectively, and to supply the developer to the development roller 38, and a collecting unit to collect excess developer left after the electrostatic latent image is developed. In addition, the collecting unit includes a collection container 50 to collect the developer supplied between the development roller 38 and the photoconductive drum 10 and to return the developer to the toner reservoirs 55, 57, 59, and 61 for each color, and a squeeze roller 26 to press the photoconductive drum 10 on which the image is developed, and to squeeze the solvent contained in the developed image. The collecting unit further includes a separator 66 to collect the squeezed developer through the collection container 50, to separate color toner from the collection container 50 and to return the solvent to a solvent reservoir 65.

In the above structure, in order to perform a development operation, a developer having four colors, such as yellow (Y), magenta (M), cyan (C), and black (K), with a toner concentration of about 2–3% solid, is provided in the toner reservoirs 55, 57, 59, and 61. Of course, in the case of a system to develop a single color, such as black, only one developer is required. In order to prepare a developer for each color, the developer supplying unit fabricates a developer with a corresponding concentration by supplying the concentrated developer and the pure solvent from the concentration cartridges 82 and 84 and the solvent cartridge 86 to the toner reservoirs 55, 57, 59, and 61, respectively. For this purpose, each of the toner reservoirs 55, 57, 59, and 61 measures the concentration of the developer that is mixed according to a concentration sensor (not shown). Likewise, when the developer is prepared, the development operation begins. First, the photoconductor charging apparatus 14 charges the photoconductive drum 10 to a predetermined potential. In this state, the imaging apparatus 16 scans light on the charged photoconductive drum 10 to form an electrostatic latent image of a desired image. Subsequently, the pumps 90, 92, 94, and 96 operate such that the developer provided in the toner reservoirs 55, 57, 59, and 61 is supplied between the development roller 38 and the photoconductive drum 10 through the multicolor liquid developer spray assembly 20, thereby forming the electrostatic latent image. The developed image is transferred to the intermediate transfer member 30 and is printed directly onto the paper 72 if the developed image is formed of only one color. However, if a color image is implemented by overlapping a developer having a plurality of colors, the charge, exposure, and development operations are repeated for each of the colors. For example, if there are four colors, such as yellow (Y), magenta (M), cyan (C), and black (K), the developed image for each color is overlapped on the intermediate transfer member 30. The overlapped color image is printed onto the paper 72 passing through a space between the intermediate transfer member 30 and an impression roller 71.

However, the structure of the system in the operations from preparing the developer to supplying and collecting the developer is considerably complicated. For this reason, a concentrated high-concentration developer cannot be directly used in the development operation, and instead, a low-concentration developer (less than 3% solid) is used in the development operation. Of course, if the developer with a low concentration is used, mobility is improved, and thus a difference in density of toner throughout the image is reduced. However, as described above, the concentrated developer and solvent are in each of the cartridges 82, 84, and 86, are sent to the toner reservoirs 55, 57, 59, and 61, and mixed with a developer with a low concentration, and thus an electrostatic latent image is developed with the developer having a low concentration. Then, the solvent contained in the developed image is squeezed and collected so that the developer has a high concentration suitable for printing. To make things worse, the size and cost of embedded devices further amplify the problems of this complicated structure.

Thus, in order to solve these problems, a new image developing system is required.

SUMMARY OF THE INVENTION

Accordingly, it is an object of the present invention to provide a liquid image developing system having an improved structure in which a high-concentration developer is smoothly used in a development operation without requiring squeezing.

Additional objects and advantages of the invention will be set forth in part in the description which follows and, in part, will be obvious from the description, or may be learned by practice of the invention.

The foregoing and other objects are achieved by providing a liquid image developing system. The system includes a development container to store a developer; a photosensitive body; a development roller partially soaked in the developer in the development container and to rotate opposite to the photosensitive body; a metering blade to scratch the developer attached to a circumference of the development roller to a predetermined thickness; a depositing plate spaced a predetermined distance from the development roller to form a space therebetween; a supplying portion to supply the developer to the space between the development roller and the depositing plate; and a power supply to apply a voltage to the depositing plate so that the developer is transferred to the development roller from the space by an electric force.

BRIEF DESCRIPTION OF THE DRAWINGS

These and other objects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
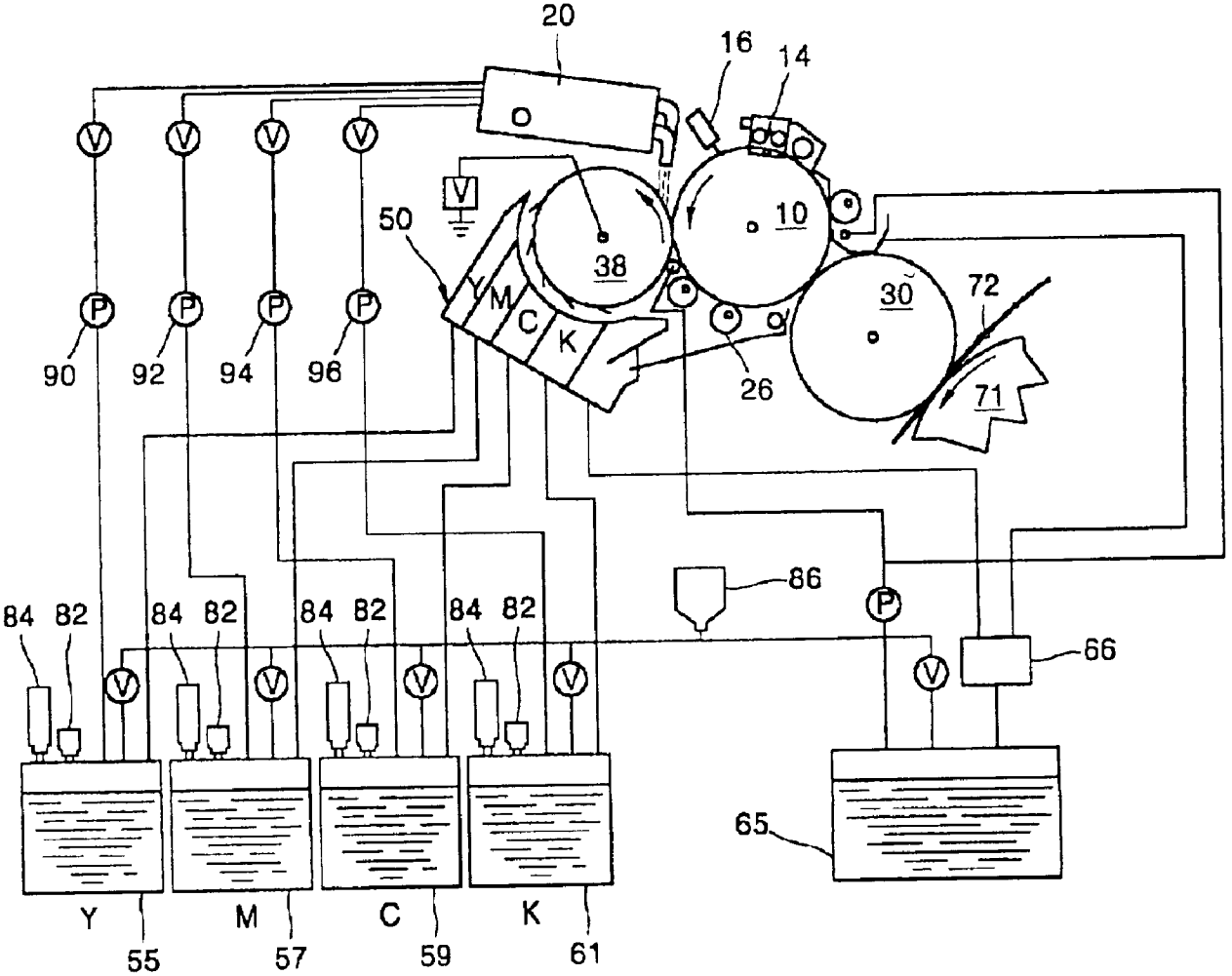
FIG. 1 (PRIOR ART)
FIG. 1 illustrates a conventional image developing system.
Figure 2:
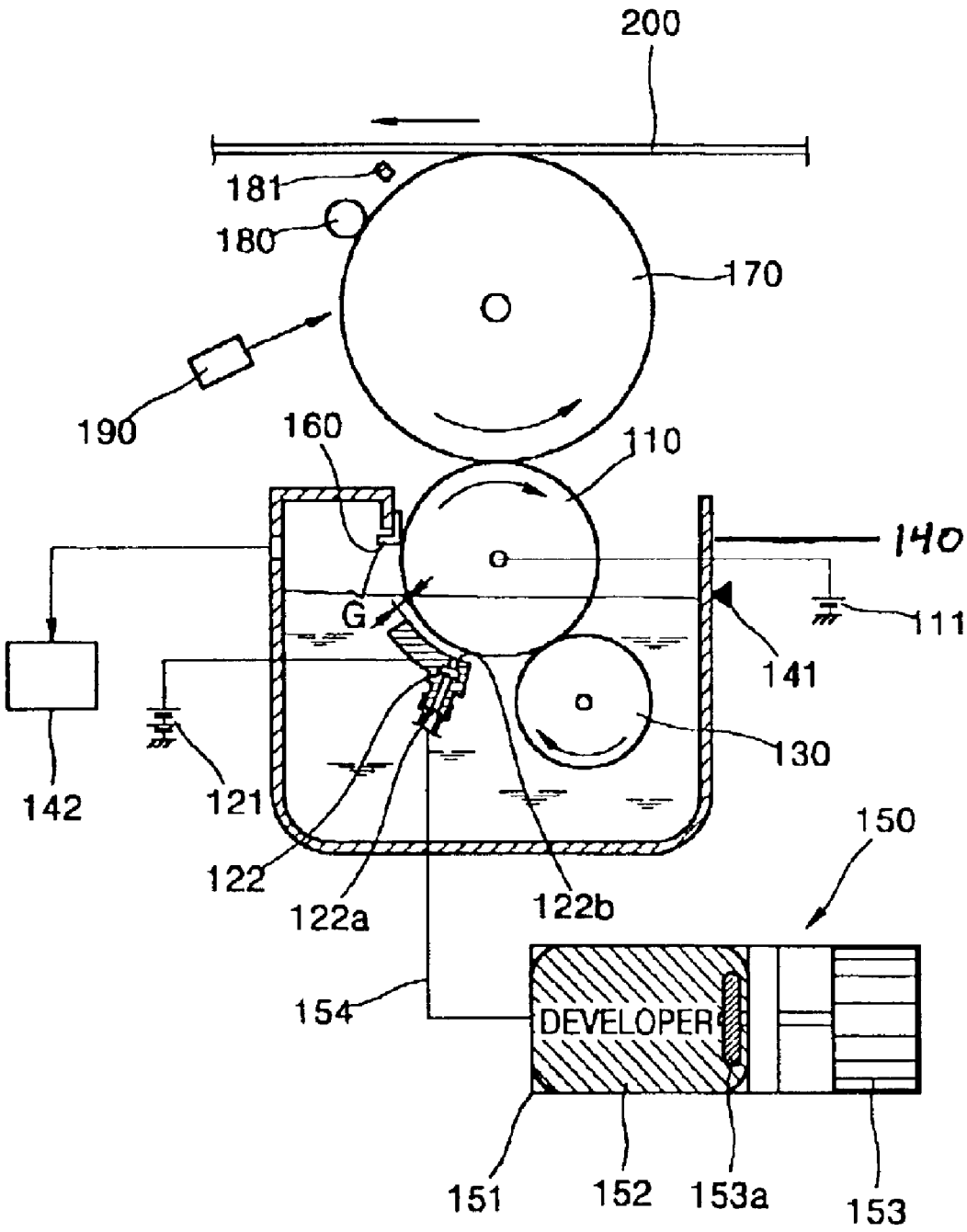
FIG. 2 illustrates a liquid image developing system according to an embodiment of the present invention.

FIG. 2 illustrates a liquid image developing system according to an embodiment of the present invention. As shown in FIG. 2, the liquid image developing system includes a cartridge 150 in which developer with a concentration of about 3–40% solid is stored, and a development container 140 to which the developer is supplied from the cartridge 150.

Within the development container 140 there are provided a development roller 110 which is partially soaked in the developer and rotates opposite to a photosensitive body 170, a metering blade 160 to scratch the developer stained on the surface of the development roller 110 to a predetermined thickness, a depositing tool to apply an electric potential to attach the developer to the surface of the development roller 110, and a cleaning portion to clean the surface of the development roller 110.

Figure 3:
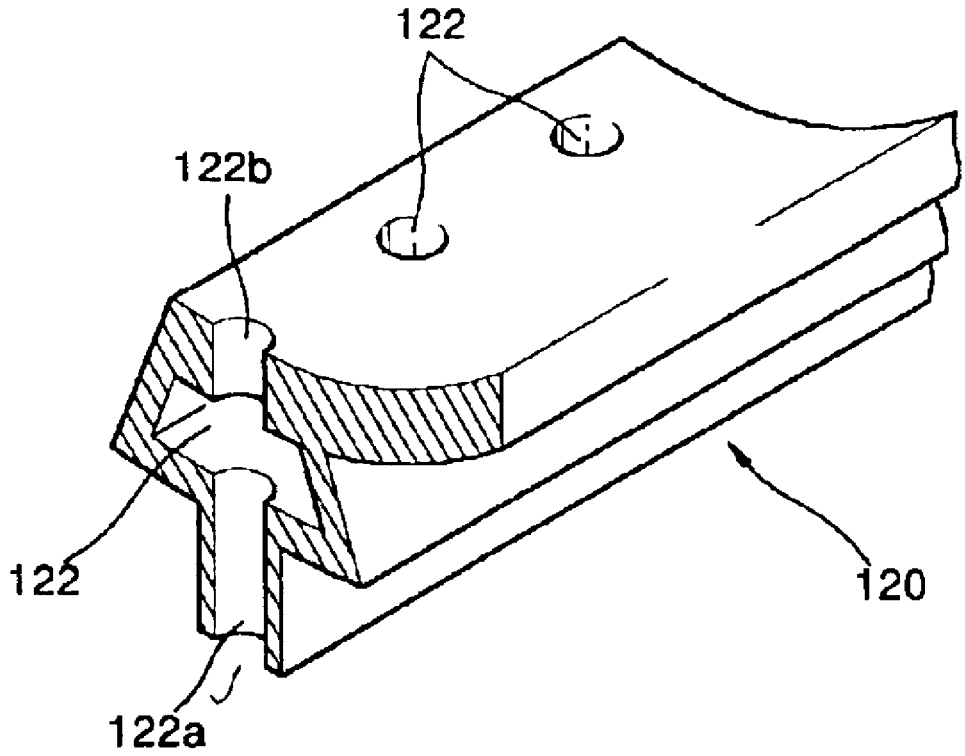
FIG. 3 illustrates the depositing plate shown in FIG. 2.

The depositing tool includes a depositing plate 120 (see FIG. 3) opposite to the development roller 110, having the same curvature as the circumference of the development roller 110. The depositing plate 120 is spaced from the development roller 110 to form a power supply part 121 to apply a voltage to the depositing plate 120, and a supplying portion to supply the developer across the gap G. The supplying portion includes the cartridge 150 and a connection line 154 to connect the cartridge 150 to an inlet side 122*a* of a through hole 122 to supply the developer through the through hole 122. Thus, the developer supplied from the cartridge 150 flows in the inlet side 122*a* from the connection line 154 and out to an outlet side 122*b* of the through hole 122. The developer in the development container 140 is supplied by this route. The depositing plate 120 may be a stainless material and can attach the developer to the development roller 110 by an electric force due to the voltage applied from the power supply part 121. In this case, the gap G is between 100–500 $\mu$m (for example, 300 $\mu$m).

The cartridge 150 includes a case 151, a tube 152 built in the case 151 in which the developer is contained, and a piston 153 with one side 153*a* attached to the tube 152, to perform a reciprocating movement in the case 151. Thus, if the piston 153 compresses the tube 152, the developer in the tube 152 is supplied to the through hole 122 of the depositing plate 120 through the connection line 154. The piston 153 and the tube 152 are shown as an example of a structure to supply and eject the developer, however, other structures, such as a pump may instead be used.

The cleaning portion includes a cleaning roller 130 to rotate in contact with the development roller 110. The cleaning roller 130 has a porous surface and rotates to contact the development roller 110 and cleans toner particles that are not developed.

The development roller 110 may be formed of polyurethane rubber or NBR as a conductive elastomer. The development roller 110 may have a resistance of about $10^5$ to about $10^8$ ohm, a hardness of shore A 25–65 degrees, and a surface roughness Ra of about 1–4 $\mu$m.

Figure 4:
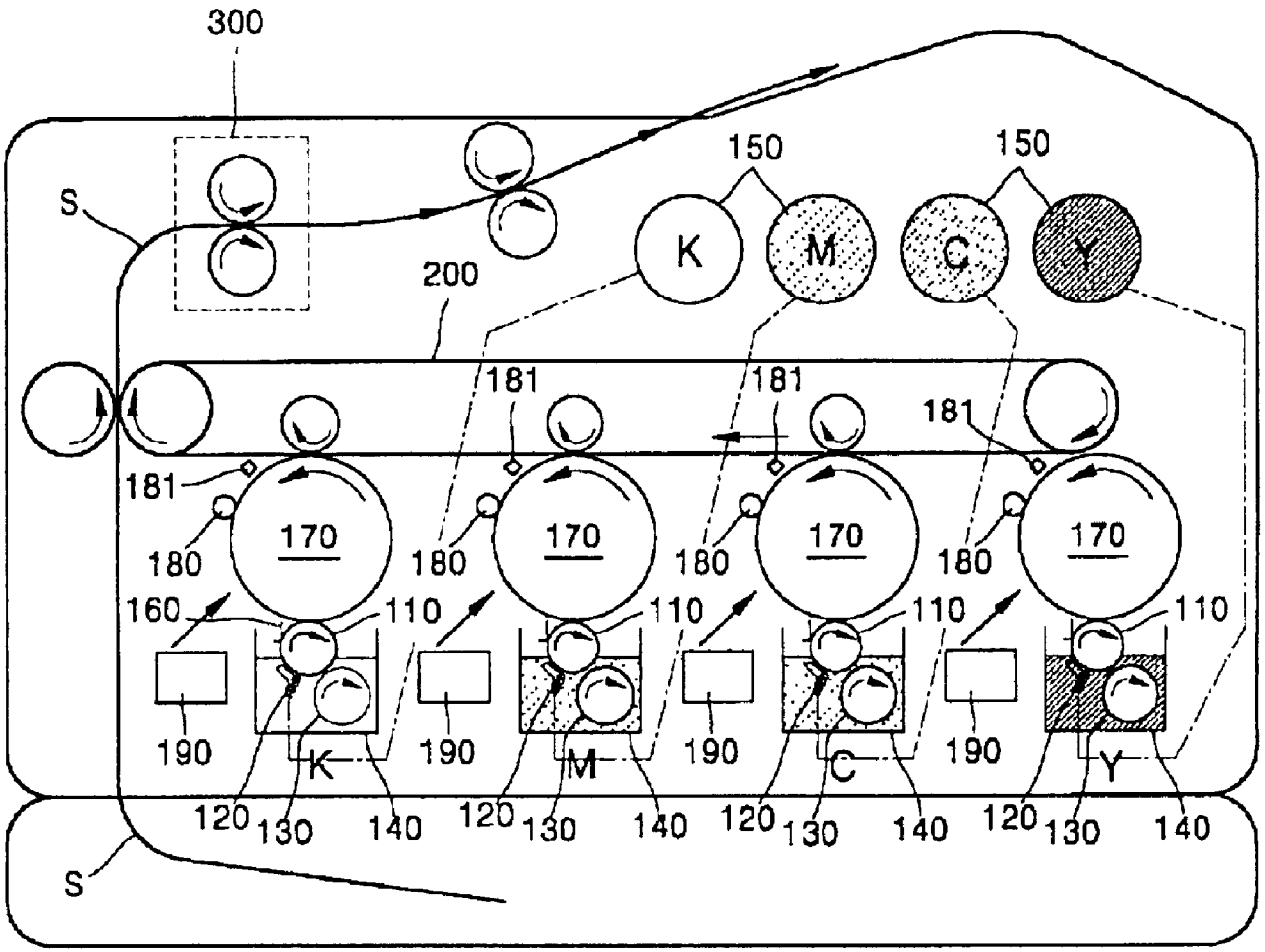
FIG. 4 schematically illustrates a printer having a plurality of the image developing systems shown in FIG. 2.

In FIG. 2, reference numeral 111 denotes a development power supply part to apply a development voltage to the development roller 110, and reference numeral 200 denotes a transfer belt to transfer the image developed on the photosensitive body 170 and print the transferred image onto the paper S (shown, for example, in FIG. 4). Furthermore, reference numeral 180 denotes a charging roller to charge the photosensitive body 170, and reference numeral 190 denotes a laser scanning unit to scan light on the photosensitive body 170 and form an electrostatic latent image. In addition, reference numerals 181 and 141 denote an eraser and a level sensor, respectively.

Only one image developing system 100 is provided in a printer using a single color, but as shown in FIG. 4, the above-mentioned image developing system is used in a color image forming device to overlap and print a plurality of colors.

In the structure of FIG. 4, in order to perform a development operation, the corresponding cartridge 150 supplies the developer for each color to the development container 140, via the connection line 154, and to the through hole 122 of the depositing plate 120 such that part of the depositing plate 120, part of the cleaning roller 130, and part of the development roller 110 are soaked in the development container 140. As described above, the charged developer is a high-concentration developer with a concentration of about 3–40% solid (for example, 3–12% solid). After the development container 140 is charged at a proper level, the development operation starts. In this case, the developer is slow and continuously supplied to the gap G, and overflowed developer is sent to a return reservoir 142. Then, bias voltages of about 300–550 V and about 500–1550 V are applied to the development roller 110 and to the depositing plate 120, respectively. The bias voltage applied to the development roller 110 lies between a voltage of about 900V applied to the photosensitive body 170 by the charging roller 180 and a voltage of about 100V applied to a portion in which an electrostatic latent image is formed by the laser scanning unit 190. If the bias voltage is applied to the development roller 110 in this way, toner particles of the developer are positively charged, and thus attach to the surface of the development roller 110 by a voltage difference between the development roller 110 and the depositing plate 120. In such a case, toner particles may electrically strongly or weakly attach to the development roller 110. According to an experiment, the concentration of the developer attached to the development roller 110 by an electric force before passing the metering blade 160 when the developer with a concentration of about 3–12% solid is used, is 6–14% solid with a mass/area (M/A) of 400–1100 $\mu g/cm^2$. When the developer with a concentration of 3% solid, which is a relatively low concentration, is used, the concentration of the development roller 110 is 6% solid, twice as much as the initial concentration. When a developer with a concentration of 12% solid is used, the concentration of the development roller 110 slightly increased to about 12–14% solid. However, before passing the metering blade 160, a concentration difference of the developer is large, and thus it is difficult to develop an image with a uniform concentration if the electrostatic latent image formed on the photosensitive body 170 is developed without change.

Afterwards, the developer stained on the development roller 110 is scratched by the metering blade 160 to a predetermined and uniform thickness. In order to form the metering blade 160, a metal plate having a thickness of 0.05–2 mm is formed in an L-shape so that a curved portion contacts the development roller 110 on the surface of the developer. However, if the metering blade 160 scratches the developer closely attached to the development roller 110 and stained on the surface of the development roller 110, various modifications are possible. For example, a voltage may be applied to the metering blade 160, and pressure, contact position, and the shape of a contact portion of the development roller 110 may be modified. Of course, under the above conditions, the M/A left on the surface of the development roller 110 before the development operation gradually varies. When the developer with a concentration of about 3–40% solid is used, and these conditions are slightly changed, the M/A on the development roller 110 before the development operation is about 150–500 $\mu g/cm^2$, thereby a relatively uniform concentration is achieved. In particular, when the developer with a concentration of about 3–12% solid is used, the concentration and M/A of the developer stained on the development roller 110 after passing through the depositing plate 120 is about 5.7–14% solid and 413–1126 $\mu g/cm^2$, respectively. The concentration and M/A of the developer stained on the development roller 110 before the development operation after passing through the metering blade 160 is about 19.6–31% solid and 220–270 $\mu g/cm^2$, respectively, showing a considerably uniform distribution. In this case, the distance between the depositing plate 120 and the development roller 110 is about 70–100 $\mu m$, and the voltage difference between the development roller 110 and the depositing plate 120 is 500 V. Thus, the concentration of the developer before the development operation can be maintained uniform and the developer can be used in the development operation even though a developer within a wider range of a concentration, i.e., 3–12% solid, is used.

Subsequently, contact development is performed on the photosensitive body 170 using the development roller 110 on which the developer with the above concentration is stained. In such a case, as described above, the potential of the charged photosensitive body 170 is 900 V, the potential of a portion in which the electrostatic latent image is formed is 100 V, and the moving speed of the transfer belt 200 is 5.83 inch/sec. For these values, the M/A and concentration of the development roller 110 before the development operation is 200–250 $\mu g/cm^2$ and greater than 18% solid, respectively. Under these conditions, the M/A of an image in an image region in which the electrostatic latent image on the photosensitive body 170 is formed is 200 $\mu g/cm^2$. In the image portion, an optical density (OD) of 1.3–1.4 is achieved, indicating a good development efficiency. In the non-image portion, an optical density (OD) of less than 0.03 is measured, therefore there is less contamination in the non-image portion. In addition, the concentration of the developer of the image developed on the photosensitive body 170 is high (greater than 25% solid) without the flow of excess solvent. Since a state suitable for transfer has been already formed even if a squeezing operation is not performed, an additional squeezing operation is not necessary. The toner particles left on the development roller 110 after the development operation are removed by the cleaning roller 130 soaked in the development container 140.

The developed image is transferred onto the transfer belt 200, and if the developed image is formed of only one color, the developed image is printed directly onto the paper S. However, in the case of implementing a color image (see FIG. 4), each image developed by each developing system for four colors, such as yellow (Y), cyan (C), magenta (M), and black (K), is overlapped on the transfer belt 200, and then is printed onto the paper S. Then, the paper S passes through a fusing unit 300, is heated, impressed, and exhausted.

In the image developing system, the high-concentration developer can be directly used in the development operation without a dilution operation, and thus the structure to supply the developer can be considerably simplified, and the squeezing operation of squeezing excess solvent can be omitted. In addition, the developer stained on the development roller in the development operation can be maintained at a uniform concentration.

As described above, the liquid image developing system according to the present invention has the following advantages. First, since the high-concentration developer put in the cartridge is supplied directly to the development container without an additional dilution operation to perform the development operation, the structure to supply the developer can be simplified, and thus the overall size of a printer can be reduced.

Second, using the metering blade, the distribution of the concentration of the developer in the development container and the concentration of the developer on the development roller can be uniform, and thus a controller to dilute the developer and adjust the concentration of the developer is not required, as in the conventional designs.

Third, as the concentration of the developer is increased, the spread of the image is reduced, thereby achieving a high quality image capable of preventing the contamination of the non-image portion.

Fourth, by performing the development operation using the high-concentration developer, a squeezing operation can be omitted.

Fifth, due to the omission of the squeezing operation, dwell time can be reduced, thereby performing printing work at a higher speed.

Although a few preferred embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A liquid image developing system comprising:

a development container to store a developer;

a photosensitive body;

a development roller partially soaked in the developer in the development container, to attach the developer thereto and to rotate in a direction opposite to a direction of rotation of the photosensitive body;

a metering blade to scratch the developer attached to the development roller to a predetermined thickness;

a depositing plate spaced from the development roller to form a space therebetween, the depositing plate comprising a through hole formed therein, the through hole having an inlet side and an outlet side in communication with the space;

a supplying portion to supply the developer to the space between the development roller and the depositing plate; and a power supply to apply a voltage to the depositing plate so that the developer is transferred to the development roller from the space by an electric force.

2. The system of claim 1, wherein the supplying portion comprises:

a cartridge in which the developer is stored, and a connection line to connect the inlet side of the through hole to the cartridge.

3. The system of claim 1, wherein the depositing plate comprises a side opposite to the development roller, wherein the side has a same curvature as a curvature of the development roller.

4. The system of claim 1, further comprising a cleaning portion to clean the development roller.

5. The system of claim 4, wherein the cleaning portion comprises a cleaning roller to rotate in contact with the development roller.

6. The system of claim 1, wherein a concentration of the developer is 3–40% solid.

7. A liquid image developing system, comprising:

a container to store a developer;

a development roller to receive the developer;

a photosensitive body to receive the developer from the development roller; and a depositing plate in the container and spaced from the development roller to form a space therebetween, the developer being disposed in the space and received by the development roller from the space, wherein the depositing plate comprises a through hole formed in the depositing plate, the through hole having an inlet side, and an outlet side in communication with the space.

8. The system of claim 7, wherein a concentration of the developer is 3–40% solid.

9. The system of claim 7, wherein the depositing plate includes a side opposite to the development roller, and the side has a same curvature as a curvature of the development roller.

10. The system of claim 7, wherein the developer is directly received by the development roller without a dilution operation.

11. The system of claim 7, further comprising:

a cartridge in which the developer is contained; and a supply line to supply the developer from the cartridge to the inlet side of the depositing plate.

12. The system of claim 7, further comprising a power supply to apply a voltage to the depositing plate, wherein the developer is transferred to the development roller by an electric force resulting from the applied voltage.

13. The system of claim 7, wherein the depositing plate is 100–500 microns from the development roller.

14. The system of claim 7, wherein the development roller is formed of polyurethane rubber or NBR, having a resistance of $10^5$ to $10^8$ ohm, a hardness of shore A 25–65 degrees, and a surface roughness of 1–4 $\mu$m.

15. A liquid image developing system, comprising:

a container to store a developer;

a development roller to receive the developer;

a photosensitive body to receive the developer from the development roller;

a depositing plate spaced from the development roller to form a space therebetween and soaked in the developer, the developer being disposed in the space and received by the development roller from the space; and a plurality of the containers, each storing the developer to develop a different color, and the system develops a multi-colored image.

16. A method to generate an image, comprising:

soaking a depositing plate having a through hole formed therein in a developer;

partially soaking a development roller in the developer, a space existing between the depositing plate and the development roller; and generating a voltage difference between the development roller and the depositing plate to attach the developer to the development roller.

17. An apparatus, comprising:

a container to store a developer;

a roller;

a plate in the container and spaced from the roller, having a hole therethrough to pass the developer from the container to the roller; and a photosensitive body to receive the developer from the roller.

* * * * *